United States Patent [19]

Galbiati

[11] Patent Number: 4,495,751

[45] Date of Patent: Jan. 29, 1985

[54] APPARATUS AND METHOD FOR PACKAGING ARTICLES IN A FLEXIBLE WRAPPING MATERIAL

[75] Inventor: Ambrogio Galbiati, Milan, Italy

[73] Assignee: W. R. Grace & Co., Cryovac Div., Duncan, S.C.

[21] Appl. No.: 317,692

[22] Filed: Nov. 2, 1981

[30] Foreign Application Priority Data

Nov. 11, 1980 [GB] United Kingdom ..... 8036189

[51] Int. Cl.[3] ..... B65B 43/42

[52] U.S. Cl. ..... 53/576; 53/581

[58] Field of Search ..... 53/575–577, 53/291, 581

[56] References Cited

U.S. PATENT DOCUMENTS 3,461,648 8/1969 Ashton ..... 53/576
3,553,924 4/1971 Bonami ..... 53/577 X
4,118,915 10/1978 Swenson ..... 53/291

FOREIGN PATENT DOCUMENTS 2804191 8/1979 Fed. Rep. of Germany ..... 53/576

*Primary Examiner*—A. J. Heinz
*Attorney, Agent, or Firm*—John J. Toney; William D. Lee, Jr.; Joseph P. Harps

[57] ABSTRACT

An apparatus and process for forming and dispensing individual wrappers of varying lengths from a supply roll of flat-folded tubular film is provided. The apparatus includes a rotatable turret which defines a plurality of appertures and has a plurality of hollow mandrels secured thereto in such manner that the interior of each hollow mandrel is communicatively connected to a respective apperture. In operation, a mandrel and tubular film loaded on the external periphery thereof is rotatively indexed from a stock receiving station to a stock dispensing station where the tubing is sealed, loaded with a product and severed to form an individual wrapper. A guide bullet is provided at the stock receiving station to assist in the loading of the tubular film onto the external periphery of a hollow mandrel upon the mandrel being indexed to the stock receiving station. In a preferred embodiment the guide bullet may be retracted through the interior of a mandrel by way of a reciprocal thrust rod.

22 Claims, 1 Drawing Figure

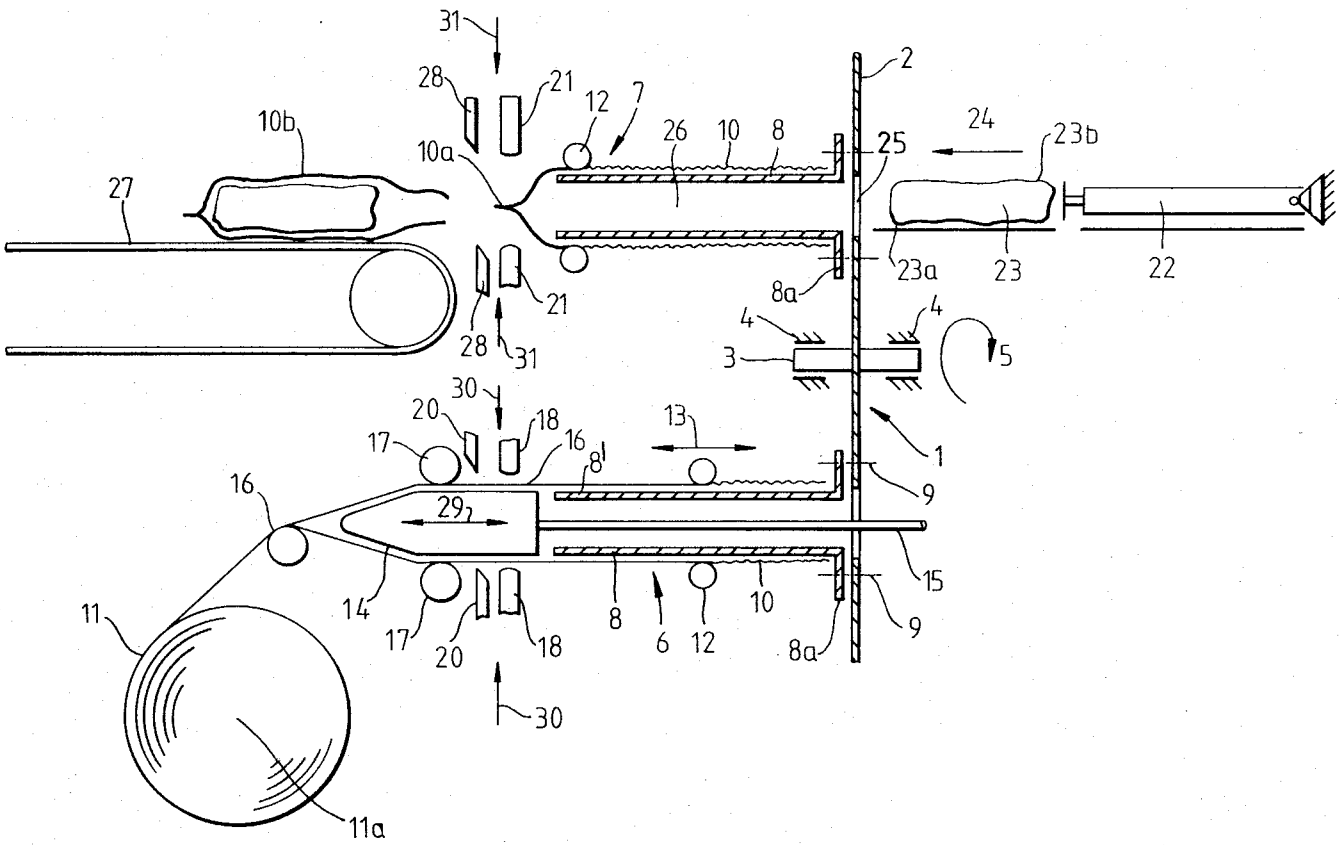
22
23b
23
24
5
23a
4
1
9
15
9
2
25
8a
8a
8
10
4
3
10
12
26
13
6
7
8
12
8
16
21
21
18
18
30
31
31
28
28
30
10a
20
29
20
17
17
14
11a
10b
16
27
11

APPARATUS AND METHOD FOR PACKAGING ARTICLES IN A FLEXIBLE WRAPPING MATERIAL

DESCRIPTION

The present invention relates to a method of and an apparatus for packaging articles in a flexible wrapping material, in particular in wrapping material which is supplied in the form of a continuous tubing stock which can be cut to a suitable length to provide for an article to be contained within that cut length and to have at its ends sufficient surplus material to form end seals to completely enclose the article.

It is known to form packs by introducing product articles through a hollow loading horn into a supply of tubular plastic wrapper material being dispensed from around the exterior of the loading horn, so that the wrapper can be sealed in front of the leading edge of the article leaving the horn and also behind the trailing edge of the article leaving the horn so as to provide a discrete package, and the remaining stock tubular material on the loading horn can then be used for a subsequent wrapper and article. Such a system is disclosed in U.S. Pat. No. 3,945,171 granted May 23, 1976 to Marietta Junior et al. U.S. Pat. No. 3,892,059 issued on July 1, 1975 to Widigs discloses a system in which a tube of receiving tubular stock material and then serving as a loading mandrel has two operative positions in a machine, with the first position arranged such that a supply of tubular stock material can be placed on the exterior of the tube over one end thereof, and a second operative position in which the same tubular stock material can be dispensed by being withdrawn from the said one end of the tube for twisting round product articles fed along the tube, using the tube as a loading mandrel.

The machines disclosed in the two above-mentioned U.S. patents have the disadvantage that the loading horn or mandrel needs to be manipulated by hand into the stock-dispensing position once a supply of tubular stock material on a previous similar loading horn or mandrel is consumed, and then the apparatus needs to be carefully set up in order to initiate a production sequence using the tubular stock material on the freshly positioned loading horn or mandrel.

The present invention aims to overcome the disadvantages of these known arrangements and to provide a method of and apparatus for packaging product articles in flexible wrappers formed from tubular stock material, requiring the minimum of manual intervention and enabling high production rates to be achieved.

In accordance with one aspect of the present invention there is provided a process for packaging an article in a wrapper comprising the steps of loading wrapper stock material on a tubular mandrel at a stock-receiving station, rotating the tubular mandrel from the stock-receiving station to a stock-dispensing station, and dispensing the tubular wrapper stock onto articles within the wrapper at the stock-dispensing station.

More specifically, the invention also provides a process for packaging articles in flexible wrappers, comprising: providing a plurality of hollow mandrels on a rotatable turret passing the mandrels successively from a tubular film stock-receiving station to a tubular film stock-dispensing station by indexing rotation of the turret; providing a supply of flat-folded tubular film stock material at the stock-receiving station; advancing said tubular film stock material onto the external periphery of a said hollow mandrel at the stock-receiving station to generate a build-up of tubular stock material on the hollow mandrel; severing the said build-up of tubular stock material from the said supply of tubular stock material at the stock-receiving station; indexing the turret to bring the hollow mandrel with the said build-up of tubular stock material thereon from the receiving station to the stock-dispensing station; and at the stock-dispensing station dispensing said build-up of tubular stock material from the external periphery of the mandrel as a wrapper onto a succession of articles which are passed along the interior of the hollow mandrel within the tubular stock material being dispensed from the external periphery of said mandrel.

The invention also provides apparatus for packaging an article in a wrapper comprising: rotatable turret means; and tubular mandrel means mounted on said turret means, whereby said tubular means are rotatable from a stock-receiving station to a stock-dispensing station.

A further aspect of the invention provides apparatus for packaging articles in wrappers formed from tubular film stock material, comprising a turret carrying a purality of parallel hollow mandrels mounted for indexing movement between a tubular film stock-receiving station and tubular film stock-dispensing station; means at said tubular film stock-receiving station for advancing tubular film stock material onto a respective said hollow mandrel thereat; means at said tubular film stock-dispensing station for delivering a product article along the interior of said hollow mandrel thereat for emergence of said product article from a delivery end of said hollow mandrel in the same direction as, and within, tubular film stock material being dispensed from said hollow mandrel; and means for closing the leading end of a wrapper defined by dispensed tubular film stock material at said stock-dispensing station.

In the above apparatus and process, mandrels are rapidly and easily loaded with a supply of tubular stock material from the supply roll and can then undergo a precisely controlled and automatically driven indexing motion from the stock-receiving station to the stock-dispensing station where articles are automatically packaged in a wrapper formed by closing at opposite ends of the article as the tubular stock material is withdrawn from the mandrel by emergence of the article from the mandrel.

The thus formed wrapper can either be closed at both the leading and the trailing ends before advancing to a packaging machine, or alternatively the trailing end of the wrapper can be left open so that the article can be fed to a vacuum chamber which will automatically evacuate the interior of the loaded wrapper and close the trailing end thereof, by any suitable closing means such as a hot weld seal or closure by a deformable clip. Such a vacuum chamber for vacuum-clipping is disclosed in U.S. Pat. No. 3,763,620 issued Oct. 9, 1973 to Giraudi et al.

In order that the present invention may more readily be understood the following description is given, merely by way of example, with reference to the accompanying drawing in which the sole FIGURE shows one embodiment of apparatus for packaging articles in wrappers formed from tubular stock material.

The apparatus shown in the drawing comprises a turret generally referenced 1, having a mandrel carrier disc 2 mounted on a rotatable pivot shaft 3 received in bearings 4 of the machine frame and rotatable in the direction indicated by the arrow 5.

At the bottom of the drawing is the tubular stock-receiving station 6 and at the top is the diametrically opposite tubular stock-dispensing station 7; the rotation of the carrier disc 2 carries the successive mandrels 8 between the receiving station 6 and the dispensing station 7. The individual mandrels 8 are secured to the carrier disc 2 by means of their end flanges being secured by bolts the longitudinal axes 9 of which are illustrated.

At the stock-receiving station 6 the respective mandrel 8 is supplied with a build-up 10 of shirred tubular stock material from a supply roll 11 mounted on a spindle whose axis of rotation 11*a* is illustrated in the drawing. The shirred build-up 10 is retained by retaining means 12, in this case in the form of a set of rollers supported with respect to the carrier disc 2 by suitable non-illustrated support means. As illustrated by the double-ended arrow 13, the retaining rollers are mounted for movement axially along the mandrel 8 in either direction, in a manner to be described below.

A guide bullet 14 is mounted on a thrust rod 15 which enables the guide bullet 14 to be fully retracted beyond the righthand side of the carrier disc 2 in order to allow indexing rotation of the carrier disc 2 to carry the loaded mandrel 8 away from the stock-receiving station 6 and on its path towards the stock-dispensing station 7. However, in the position shown in the drawing, this guide bullet 14 serves to open the flat-folded tubular film stock on the supply roll 11 as it passes from a guide roller 16 and towards a set of stock-advancing rollers 17, of which there may be two or more in number equiangularly spaced around the periphery of the guide bullet 14, and onwards to the external periphery of the end 8' of the mandrel 8.

Suitable closing means, in this case in the form of hot welding bars 18, are provided around the stock-opening position of the guide bullet 14 in order to close the tubular stock material 19 after retraction of the guide bullet 14 as cutting blades 20 co-operate to sever the shirred build-up 10 of tubular stock material on the mandrel 8 from the remainder of the tubular stock material on the supply roll 11.

At the stock-dispensing station 7, the shirred build-up 10 of tubular stock material is intermittently withdrawn by emerging product articles 23 being wrapped, until the entire build-up 10 has been consumed and the mandrel 8 is automatically indexed towards the stock-receiving station 6 for supply with another build-up 10 of shirred tubular stock material.

The particular set of build-up retaining rollers 12 which is carried by the carrier disc 2 and is related to the individual mandrel 8, again serves to control the withdrawal of the tubular stock material from the shirred build-up 10 to a package forming location.

Package closing means, in this case in the form of a pair of hot welding bars 21, provided at the stock-dispensing station 7 serve to seal the leading end of the build-up of shirred tubular stock material on the mandrel 8.

A loading ram 22 serves to deliver a product article 23 through the mandrel 8 at the stock-dispensing station by driving it along the direction of arrow 24 through an aperture 25 in the carrier disc and then along the aligned bore 26 of the mandrel 8 until the leading end 23*a* of the product article 23 abuts the sealed leading end portion 10*a* of the build-up 10 and then, on further leftward movement, the article 23 withdraws some of the tubular stock material in the shirred build-up 10, between the retaining rollers 12 and the mandrel until enough of the tubular stock material has been withdrawn to form one wrapper 10*b* loosely enclosing the product article on a delivery conveyor 27.

At this stage, the welding bars forming the closing means 21 come together to seal the leading end of the remainder of the build-up of shirred tubular stock material on the mandrel 8, while further cutting means in the form of co-operating knife blades 28 serve to sever the trailing end or mouth of the wrapper 10*b* from the closed leading end 10*a* of the next successive wrapper. At this stage the product article 23 is entirely supported by the delivery conveyor 27 and is arranged with the wrapper 10*b* having its closed end leading and its open end trailing, ready for advancing to further packaging equipment, for example a vacuum-sealing chamber where the interior of the wrapper 10*b* may be evacuated and the surplus wrapper material at the trailing end of the product article 23 can be sealed to enclose the article 23 under vacuum conditions.

If desired the product loading ram 22 may have its pusher provided with, or associated with, some form of gas flushing nozzle or suction nozzle so that a the wrapper 10*b* may be evacuated and closed before the conveyor 27 starts movement.

Although reference is made herein to the possibility of vacuum packaging of the articles within the wrappers 10*b*, it is of course alternatively possible for the packaging to be carried out in air under atmospheric pressure, or using an inert flushing gas at atmospheric pressure or below.

When the wrapper severing means 28 have severed the wrapper 10*b* from the closure area 10*a* of the remainder of the shirred build-up 10, the product delivery conveyor 27 can start movement in order to advance the loaded but unsealed wrapper 10*b* to subsequent packaging apparatus, and the severing means 28 and welding bars can open in order to allow the next successive product article 23 to emerge from the free end 8' of the mandrel 8 at the stock-dispensing station. From this it will be understood that while the first wrapper 10*b* is being severed and the leading end 10*a* of the next successive wrapper is being closed, the product loading ram 22 will have retracted (in order to allow the closing and severing means 21, 28 to operate) and will have picked up the next successive product article 23 and begun to move it along the bore 26 of the mandrel. In this way the highest possible production rate of packages from a single mandrel can be obtained.

Again, in order to speed up the operation of the process, suitable sensing means (not shown) may be provided at the stock-dispensing station in order to sense just when the product article 23 is fully supported by the conveyor belt 27 and the product loading ram 22 is free to retract. These sensing means may be in the form of either stroke-responsive means associated with the loading ram 22, or more preferably (for reasons to be explained hereinafter) some optical sensing means which is responsive to the arrival of the trailing edge of the product article 23 at a given location on the delivery conveyor 27.

Likewise, suitable timing means may be provided in order to ensure that the closing means 21 and the severing means 28 have opened sufficiently to allow the next article to emerge from the mandrel free end 8', and to block the final part of the stroke of the loading ram 22 if another article arrives in place before the closing and severing means 21 and 28 have opened.

Likewise, at the stock-receiving station 6, suitable sensing means (exemplified below) may be provided in order to ensure that, once the build-up 10 of shirred stock material has reached the desired value on the mandrel 8, the stock-advancing rollers 17 will stop rotation and the severing means 20 may be operated to separate the shirred build-up 10 from the remainder of the tubular stock material on the supply roll 11, whereupon the guide bullet 14 can be retracted in order to leave the turret 1 free to undergo indexing rotation.

The indexing rotation of the carrier disc 2 can be based on any one of a number of different incremental rotation steps:

For example, there may be a single dispensing station 7 and a single diametrically opposite receiving station 6 in which case there need only be two mandrels 8 and each indexing rotation step occupies half a rotation of the disc 2.

Alternatively, it may be arranged for there to be two or more dispensing stations 7 around the periphery of the same turret and a similar number of receiving stations 6, such that once again the indexing rotation will be half a turn but in this case second successive mandrels 8 will be advanced together from the multiple stock-receiving stations 6 to the multiple stock-dispensing stations 7.

It is even possible for an alternative arrangement to be provided where there may be a number of stock-receiving stations 6 different from the number of stock-dispensing stations 7. For example, there may be two adjacent dispensing stations 7 each of which dispenses half of the build-up 10 on any one mandrel 8 so that that mandrel is depleted as it leaves the second of the two dispensing stations through which it passes successively, but the operation of generating a build-up 10 at the single stock-receiving station may take only half the time of dispensing that same build-up at the stock-dispensing stations. This allows for changing the supply roll 11 while the loading station apparatus is in operation and thus reduces machine down-time.

Any other relationship between the number of receiving stations 6 and dispensing stations 7 may be provided, as desired.

In operation, the functioning of the apparatus shown in the drawings is as follows:

Generation of a build-up 10 on the lower mandrel 8 is initiated by leftward movement of the guide bullet 14 to the position shown in the drawing, and then initiation of drive to the rotating stock-advancing rollers 17 to begin the movement of tubular stock material from the supply roll 11 onto the mandrel 8. Some manual guidance may be required in order to guide the leading edge of the tubular stock material from the tip of the guide bullet 14 firstly onto the mandrel and then under the retaining means, in this case the axially reciprocable retaining rollers. From then in order that the build-up 10 may grow automatically the retaining rollers 12 execute repetitive movement cycles of movement rightwardly along the mandrel (whilst locked against rotation) to shirr the stock material 11 into the build-up 10, followed by radially outward spreading movement then leftward retracting movement and eventually radially inward movement ready for the start of the next cycle.

After completion of the build-up 10, the build-up responsive switching means (exemplified below) deactivates the stock-advancing rollers 17 and triggers rightward, retracting movement of the guide bullet 14 along the direction of its double-ended arrow 29.

Once the stock guide bullet 14 is clear of the stock closing means 18, the severing means 20 operates to sever the build-up from the stock material 11 and the closing means operates to close off the leading end of the shirred stock material build-up 10 (for example by clipping or hot weld sealing as desired) and the mandrel 8 is loaded and ready for indexing towards the dispensing station 7.

As the mandrel 8 leaves the stock-receiving station 6 the next successive mandrel arrives at the stock-receiving station 6 and the guide bullet 14 again moves leftwardly to the position shown in the drawing, ready for the free end of the tubular stock material to be manipulated over the guide bullet 14 and onto the mandrel 8 ready for subsequent automatic advancing of the tubular stock material to generate a build-up 10.

When a loaded mandrel 8 arrives at the stock-dispensing station 7, the exposed leading end of the shirred build-up 10 projecting from the free end 8'of the mandrel 8 is, by virtue of the similar positioning of the cutting means 28 at the stock-dispensing station and the cutting means 20 at the stock-receiving station, already of the correct extent so that the welding bars forming the closing means 21 at the dispensing station can be brought together to close the leading end of the build-up 10 at **10*a***.

Then the first product article 23 is driven along the bore 26 in the mandrel 8 by extension of the loading ram 22 until the trailing end **23*b* of that article has passed far enough beyond the plane of action of the cutting means 28 to ensure that the wrapper "trail" formed by the open mouth at the trailing end of the wrapper 10*b* is long enough to allow for subsequent evacuation and sealing of the package, if appropriate. Where the wrapper 10*b* is closed, by means (not shown) operating simultaneously with the operation of the severing means 28 and welding bars shown in the drawing, the positioning of the product article 23 on the conveyor belt 27 needs to be such that closing of the additional closing means (not shown) to the left of the cutting means 28 at the dispensing station, can close the appropriate part of the wrapper 10*b* without subjecting the trailing end of the wrapper to undue tension over the trailing edge 23*b*** of the product article.

It will of course be understood that the extension of the loading ram 22 may commence before the completion of the initial closure **10*a* made immediately after arrival of the mandrel 8 at the dispensing station, provided there is some means for interrupting the advancing movement of the product article 23 if for some reason the closing action of the welding bars 21** is delayed.

In normal operation, where the product article 23 in its open-ended wrapper **10*b* is advanced to a subsequent packaging station, the movement of the conveyor belt 27 starts after the initiation of advancing movement of the next product article 23 and the emergence of that next article 23** provides the desired stock-entraining force to ensure dispensing of the stock material at the desired rate.

This sequence of operations continues until the operator realises that there is insufficient tubular stock material left on the mandrel 8, or until a "build-up depleted" signal is generated (by means not shown) to stop further dispensing, and then with the product loading ram 22 retracted and the guide bullet 14 also retracted at the receiving station 6, the turret 1, comprising the carrier disc 2 with its various mandrels 8 and retaining means 12 thereon, is indexed.

The closing movement of the holding and severing means 18 and 20 at the receiving station 6 has been indicated by arrows 30, whilst the corresponding closing movement of the welding and severing means 21 and 28, respectively, at the dispensing station 7 has been depicted by the arrows 31.

The supply roll 11 of flat-folded tubular film stock material can readily be replaced when the supply on one roll is depleted.

The apparatus and process disclosed above are particularly convenient for use with elongate product articles such as continental sausage or sausage-shaped cheeses, and it is an advantage that where the advancing movement of the elongate product article 23 by means of the loading ram 22 is controlled in response to attainment of the desired position by the trailing edge **23*b* of the product article 23, the length of wrapper material 10*b* dispensed is directly responsive to the length of the product article so there is no need for adjustment of the apparatus in order to accommodate different lengths of product article; thus where random length articles are being fed the machine is self-adapting. Furthermore, within the range of product diameters envisaged in a particular batch, one set of mandres 8 may suffice for packaging artices 23 of varying diameters. However, it is envisaged that, thanks to the securing screws 9 holding the individual mandrels 8 on the carrier disc 2, the mandrels may themseves be replaceable in order to accommodate different diameters of tubular stock material. For this purpose the mounting flanges 8*a* of the smaller diameter mandrels 8 of a particular range of sizes will be large enough to co-operate with the same securing holes in the carrier disc 2 as are necessary for larger diameter mandrels whose mounting flanges are then able to be smaller in radial projection outwardly from the mandrel periphery. Thus although, in the drawing, the diameter of the hole 25 in the carrier plate is shown as being substantially the same as the diameter of the bore 26 in the mandrel, it may in practice be arranged for the diameter of the hole 25 in the carrier disc 2 to be equivalent to the diameter of the largest one of a range of mandrel sizes and for the mandrel bore itself to define the article-receiving hole 25 in the carrier disc in the case of the smaller diameter types of mandrel 8**.

In the above description, it is indicated that the retaining rollers of the retaining means 12 at the stock-receiving station 6 execute a motion which consists of closed cycles each consisting of a first radially inward stroke, a second advancing stroke along the mandrel, a third radially outward movement and a fourth retreating stroke along the mandrel. However, it will of course be understood that, provided a one-way clutch system is associated with the retaining rollers themselves, it is possible for the rollers to remain in contact with the tubular stock material 11 being advanced by the advancing rollers 17 in that the retaining rollers simply execute movement to-and-fro along the mandrel 8.

This latter alternative is particularly suitable in that it enables the extent of the build-up 10 of shirred tubular stock material on the mandrel 8 to be sensed in that when the build-up 10 reaches a desired magnitude the retaining rollers will be restricted in their rightward movement and this can generate a "build-up completed" signal. Alternatively, the individual retaining rollers may themselves have a rotation sensor which indicates when the total distance travelled by the rollers during the leftward "retreating" strokes of a stock-receiving operation is equal to the linear dimension of tubular stock material required to make the desired build-up 10.

As means for sensing depletion of the build-up 10 at the stock-dispensing station 7, it is possible to provide a hole extending diametrically across the mandrel and coming into register with the optical path of a photosensor so that while the light path is interrupted by the shirred build-up 10 the dispensing operation continues, but as soon as the light path diametrically across the mandrel becomes unbroken (indicating depletion of the build-up 10) the dispensing operation stops and the turret is indexed so that another full mandrel arrives at the stock-dispensing station. In practice such an arrangement will use a diametrally extending light path through the mandrel 8 near the flange **8*a* thereof for sensing the presence of a residue of the build-up 10 at the dispensing station 7. A similar pair of holes at the opposite end of the mandrel can provide the light path necessary for sensing the build-up of shirred material at the receiving station where the sensing means at the receiving station employs photosensitive characteristics. In either case, the transmissivity of light along the light path will be increased when there is either a total absence of tubular stock material or a non-shirred layer of tubular stock material present, whereas when the build-up 10 of shirred material covers the apertures forming the light path much less light or no light at all will pass. Thus in the normal state, at the dispensing station 7 the light path will remain blocked until the build-up is depleted (when the reciprocation of the product articles 23 and the pusher of the loading ram 22 will cause periodic interruptions of the light path). However, on the other hand, in the normal state of the stock receiving station 6, there will be attenuating interruption and continuity of the light path (due to reciprocation of the retaining rollers causing the build-up 10) until the build-up 10** reaches the apertures in question when there will then be continuous blockage of the light path.

Other suitable sensing means for registering the depletion of the build-up 10 at the dispensing station include electric or magnetic sensing of the presence of film material between the retaining rollers of the retaining means 12 and the end area 8' of the mandrel 8, or some other mechanism responsive to the operation of the retaining rollers 12.

As has been indicated above, it is possible for the same turret 1 to have several dispensing stations 7 arranged close to one another. Where the rotation axis of the turret shaft 3 is horizontal, as shown in the drawing, product loading rams 22 or other article drive means will normally be provided. However, it may equally be convenient to provide the turret at some other orientation, for example with the axis of the rotating shaft 3 inclined so that gravity assists in advancing the product articles 23 along the mandrels 8, or even with the axis vertical so that the mandrels themselves are also vertical and this will achieve the maximum gravity-assisted driving force on the product articles 23.

This arrangement of the axis of rotation vertical is particularly convenient because it enables one operator to insert product articles into the various mandrels 8 simultaneously at the dispensing stations through the associated apertures 25, and then suitable automatic means can be provided for controlling the descent of the product article 23 and/or dispensing of the wrappers 10*b* from the shirred build-up 10 on the mandrel so that only the desired amount of tubular stock material is withdrawn each time from the mandrel 8 before the closing means 21 and severing means 28 operate to sever one wrapper 10*b* from the simultaneously closed leading end 10*a* of the next wrapper. As with the horizontal axis embodiment described above, photosensitive means may be used in order to determine when the trailing edge of the product article 23 has passed a particular point, so that movement can then be arrested (with or without a permitted overrun in order to account for inertia of the system) in time to ensure that no excess of shirred material has been dispensed and that the length of the wrapper 10*b* is exactly matched to the length required to enclose the product article 23 therein. For example, rotation of the retaining rollers may be stopped by braking means. Clearly, in this arrangement there is no need for any product loading ram 22 to be provided, and equally the belt conveyor 27 will in all probability be re-designed in order to receive and advance the filled wrapper's movement along an appropriate path to the next packaging apparatus.

I claim:

1. A process for packaging an article in a wrapper comprising the steps of:

loading a portion of a flat-folded tubular film wrapper stock material onto an external periphery of a hollow tubular mandrel at a stock-receiving station by advancing the flat-folded tubular film wrapper stock material about a guide bullet means adapted to open said flat-folded tubular film wrapper stock material and guide said material onto said external periphery;

severing said loaded portion of said tubular film wrapper stock material from the remainder of said material;

moving the hollow tubular mandrel and said loaded portion of tubular film wrapper stock material from the stock-receiving station to a stock-dispensing station;

dispensing the tubular film wrapper stock material from the external periphery of the hollow mandrel at said stock-dispensing station to form a wrapper;

advancing an article passed through an interior of the hollow tubular mandrel into said wrapper; and moving the hollow tubular mandrel from the stock-dispensing station to the stock-receiving station.

2. A process for packaging articles in flexible wrappers, comprising the steps of:

providing a rotatable turret having at least two apertures and at least two hollow mandrels secured thereto wherein each hollow mandrel is communicatively aligned with one of said apertures and whereby the turret is adapted to rotatively index said mandrels from a tubular film stock-receiving station to a tubular film stock-dispensing station;

providing a supply of flat-folded tubular film wrapper stock material at the stock-receiving station;

advancing the tubular film wrapper stock material about a guide bullet means adapted to open said flat-folded tubular film wrapper stock material and guide said material onto an external periphery of a hollow mandrel at said stock-receiving station to build-up tubular film wrapper stock material on the external periphery of said hollow mandrel;

severing the tubular film wrapper stock material on said external surface from the supply of tubular film wrapper stock material at the stock-receiving station;

closing a severed end of the build-up of tubular film wrapper stock material at the stock-receiving station;

rotating the turret to index the hollow mandrel and the tubular film wrapper stock material on the external surface thereof from said stock-receiving station to said stock-dispensing station; and dispensing said tubular film wrapper stock material from the external periphery of the hollow mandrel at the stock-dispensing station;

advancing articles through an aperture in said turret and through an interior of the hollow mandrel at the stock-dispensing station whereby the articles are inserted within said tubular film wrapper stock material.

3. The process according to claim 2, wherein the step of advancing said tubular film wrapper stock material onto the external periphery of said hollow mandrel at the stock-receiving station comprises shirring said build-up of tubular film wrapper stock material onto the external periphery of the hollow mandrel.

4. The process according to claim 3, further comprising the steps of;

closing a leading end of said build-up of shirred tubular film wrapper stock material at the stock-dispensing station before emergence of an article from the interior of said hollow mandrel;

using the advancement of an article to withdraw an appropriate length of said tubular film wrapper stock material from the external periphery of the hollow mandrel; and severing said withdrawn length of tubular film wrapper stock material behind a trailing edge of an article which has emerged from said interior of said hollow mandrel.

5. The process according to claim 4, wherein the step of severing the withdrawn tubular film wrapper stock material behind the trailing edge of an article further comprises simultaneously closing a leading edge of said tubular film wrapper stock material build-up remaining on the mandrel.

6. The process according to claim 5, wherein the article which has been inserted within said tubular film wrapper stock material is advanced from said stock-dispensing station to a packaging station where the tubular film wrapper stock material is finally closed.

7. The process according to claim 6, wherein the tubular film wrapper stock material is finally closed under vacuum conditions in a vacuum chamber.

8. The process according to claims 2 or 1 further comprising the step of retracting said guide bullet means prior to the severing of the tubular film wrapper stock material at said stock-receiving station.

9. Apparatus adapted to package an article in a wrapper comprising:

rotatable turret means defining at least two apertures;

at least two hollow tubular mandrel means secured to said turret means wherein each hollow tubular mandrel means is communicatively aligned with a respective aperture;

a stock-receiving station comprising:

guide bullet means adapted to open and guide a supply of tubular film wrapper stock material onto an external periphery of a hollow tubular mandrel located at said stock-dispensing station;

means adapted to advance supply of tubular film wrapper stock material about said guide bullet means and onto said external periphery of said hollow tubular mandrel means to provide a build-up of said tubular film wrapper stock material onto said external periphery; and means adapted to sever said build-up from said tubular film wrapper stock material; and a stock-dispensing station comprising:

means adapted to dispense the build-up in the form of wrappers; and loading ram means adapted to pass an article through an interior of said hollow tubular mandrel means and to insert said article into said wrapper;

wherein said rotatable turret means is adapted to index said hollow tubular mandrel means between said stock-receiving station and said stock-dispensing station.

10. The apparatus according to claim 9, wherein said rotatable turret means has a substantially vertical axis of rotation and said hollow tubular mandrel means are substantially parallel to said vertical axis.

11. The apparatus according to claim 9, further comprising a delivery conveyor adapted to advance an article and an associated wrapper from said stock-dispensing station to a subsequent packaging station.

12. The apparatus according to claim 9 wherein said stock-dispensing station further comprises means for closing a leading end of said build-up and form said wrappers.

13. The apparatus according to claims 12 or 9 wherein said stock-dispensing station further comprises means for severing a first dispensed wrapper from said build-up.

14. The apparatus according to claim 12, wherein each of said hollow mandrel means further comprises means for retaining a shirred build-up of tubular film wrapper stock material on said external periphery.

15. The apparatus according to claim 12, wherein said closing means comprises a pair of opposed welding bars.

16. The apparatus according to claim 12, wherein said closing means comprises a clipping device.

17. The apparatus according to claim 9, wherein said stock-dispensing station further comprises means responsive to a trailing edge of an article whereby said means controls the movement of an emerging article and insures that the length of a dispensed wrapper is related to the length of said article.

18. The apparatus according to claim 9, wherein said rotatable turret means has a substantially horizontal axis of rotation and said hollow mandrels are substantially parallel to said horizontal axis.

19. The apparatus according to claim 9, wherein said means for passing an article through the interior of said hollow tubular mandrel comprises a product-loading ram aligned with the interior of a hollow mandrel means located at said stock-dispensing station.

20. The apparatus according to claim 9, wherein said guide bullet means is mounted on thrust rod means and is adapted to be retracted through the interior of a hollow mandrel means and emerge from an apparature.

21. The apparatus according to claim 20, wherein said guide bullet means further comprises programming means for controlling movement of said product-loading ram and of said guide bullet means, whereby said product-loading ram and said guide bullet means are adapted to individually axially reciprocate within respective hollow mandrel means and emerge from respective apparatures during each reciprocation, and indexing of said turret means occurs only when both said product-loading ram and said guide bullet means have emerged from their respective apparatures.

22. The apparatus according to claims 20 or 21, wherein said guide bullet means further comprises a plurality of film stock-advancing rollers co-operating with an external periphery of said guide bullet means.

* * * * *

UNITED STATES PATENT AND TRADEMARK OFFICE

CERTIFICATE OF CORRECTION

PATENT NO. : 4,495,751

DATED : January 29, 1985

INVENTOR(S) : Ambrogio Galbiati

It is certified that error appears in the above-identified patent and that said Letters Patent is hereby corrected as shown below:

In column 11, line 3, after "advance" insert --a--.

Signed and Sealed this

*Twenty-fourth* Day of *September 1985*

[SEAL]

*Attest:*

DONALD J. QUIGG

*Attesting Officer*

*Commissioner of Patents and Trademarks—Designate*